US007914238B2

(12) United States Patent
Spearing et al.

(10) Patent No.: US 7,914,238 B2
(45) Date of Patent: Mar. 29, 2011

(54) FREE STANDING SUPPORT

(76) Inventors: Anthony John Spencer Spearing, Aurora, OH (US); Joseph John Jingle, Medina, OH (US)

( * ) Notice: Subject to any disclaimer, the term of this patent is extended or adjusted under 35 U.S.C. 154(b) by 680 days.

(21) Appl. No.: 11/575,622

(22) PCT Filed: Sep. 15, 2005

(86) PCT No.: PCT/US2005/032969

§ 371 (c)(1),
(2), (4) Date: May 21, 2007

(87) PCT Pub. No.: WO2006/033968

PCT Pub. Date: Mar. 30, 2006

(65) Prior Publication Data

US 2007/0267559 A1 Nov. 22, 2007

(30) Foreign Application Priority Data

Sep. 20, 2004 (ZA) ..... 2004/7522
Jan. 21, 2005 (ZA) ..... 2005/0598

(51) Int. Cl.
*E02D 3/02* (2006.01)

(52) U.S. Cl. ..... 405/288; 405/289

(58) Field of Classification Search ..... 248/161, 248/157; 403/109.1, 83
See application file for complete search history.

(56) References Cited

U.S. PATENT DOCUMENTS 844,335 A 2/1907 Dodson
1,370,140 A * 3/1921 McDowell ..... 188/67
1,491,229 A 4/1924 Goldsmith
1,620,913 A 3/1927 Orwig
1,751,152 A * 3/1930 Harter ..... 248/412
2,348,611 A 3/1944 Davidson
2,437,510 A * 3/1948 Ditty ..... 403/105
2,636,397 A * 4/1953 Jacubenta ..... 74/424.87
2,658,777 A 11/1953 Rauglas
2,797,942 A 7/1957 Schwalbe
2,838,266 A 6/1958 Rees
2,928,643 A 3/1960 Bellman
2,961,260 A * 11/1960 Newlin ..... 403/104
3,008,742 A 11/1961 Goldstein
3,521,341 A * 7/1970 Hornlein et al. ..... 29/898.066
3,538,785 A 11/1970 Grançon
3,737,134 A 6/1973 Foon
3,871,780 A * 3/1975 Svensson ..... 403/104
3,991,964 A 11/1976 Christopher
4,183,689 A * 1/1980 Wirges et al. ..... 403/31
4,561,798 A * 12/1985 Elcrin et al. ..... 403/109.1
4,966,345 A 10/1990 Bersier (Continued)

FOREIGN PATENT DOCUMENTS

GB 1369188 * 6/1973
WO WO 96/23161 A1 1/1996

*Primary Examiner* — Terrell Mckinnon
*Assistant Examiner* — Erin Smith
(74) *Attorney, Agent, or Firm* — Sughrue Mion, PLLC

(57) ABSTRACT

A load support includes an outer tube and a plunger at least partially slidably disposed within the outer tube. Gravity-set wedging members are disposed between an outer surface of the plunger and an inner surface of the outer tube for setting the plunger and outer tube in place with respect to each other, wherein the wedging members are substantially self-setting under gravity. The wedging members gouge the outer surface of the plunger and the inner surface of the outer tube upon inward axial movement of the plunger within the outer tube.

23 Claims, 8 Drawing Sheets

U.S. PATENT DOCUMENTS 5,524,967 A 6/1996 Glockl
6,299,113 B1 10/2001 Yamashita et al.
6,609,686 B2 * 8/2003 Malizia ..... 248/125.8
2006/0039747 A1 * 2/2006 Shoda et al. ..... 403/109.1

* cited by examiner

FREE STANDING SUPPORT

CROSS-REFERENCE TO RELATED APPLICATIONS

This application claims priority from South African provisional application 2004/7622 filed on Sep. 20, 2004, and South African provisional application 2005/0598 filed on Jan. 21, 2005, which are incorporated herein by reference in their entirety.

BACKGROUND OF THE INVENTION

1. Field of the Invention

This invention relates to an elongated, free standing support, and more particularly, but not exclusively, to a free standing load support suitable for a mine prop.

2. Description of the Related Art

In the field of free standing supports, both yielding and non-yielding supports are useful as an alternative to other supports such as timber crib supports. In particular, free standing supports have been widely used in coal mining, hard rock mining, and deep tabular mines. In addition, free standing supports are used in numerous non-mining applications. Examples of such applications include support for construction sites, basement support, and for emergency conditions, such as shoring up damaged structures during and after fires.

Ideally, a free standing support should be able to accept loads of 20-200 tons. This is especially important in mining operations, as well as non-mining operations. It is desirable to provide a range of installations heights with a single support unit, and a good area of coverage of the mine roof for such a support would be at least 64 $in^2$.

With respect to yielding supports, yield is generally needed in a support because around an excavation, the rock is subjected to natural and mining induced stresses. These stresses will result in the rock tending to fracture into slabs usually sub-parallel to the walls of the tunnel. The depth and severity of these fractures are site and rock type specific, depending on factors such as the magnitude and direction of the stress of the rock, the amount of fracturing caused by blasting operations, and geological features/weaknesses such as bedding planes, joints, dykes and slips. The process of excavating the rock using explosives also causes fracturing and dilation. In general, yielding supports are used in situations which need a permanent support.

With respect to non-yielding supports, non-yield is generally needed in situations where it is desired to re-use the props and/or the area is not expected to undergo much movement. Since yielding props tend to experience a controlled damage, non-yielding props are better adapted for removal and reinstallation. Non-yielding props are therefore useful as temporary supports, especially in situations where little or no movement is expected.

Conventionally, hydraulic type units that can yield using a pressure relief valve can be used as temporary supports, but they tend to be costly and need an external power source to activate them.

Timber based props yield by making a collapsing area on the top or bottom of the pole. These types of yielding supports are more cost effective, but have several disadvantages, including: time consuming set up since they must be cut to size; difficult to transport and install because they are bulky and heavy; pose a fire risk; and their performance is variable and deteriorates over time as the timber loses moisture and becomes brittle.

Steel yielding props are known, but suffer from installation problems because it is necessary to insert wedges, tighten clamps, etc. and this is time consuming.

Conventionally, non-yielding supports take at least one minute to engage. They also tend to be heavy if designed for a high load.

Also, both yielding and non-yielding props usually require at least two persons to install, thus, resulting in high costs and manpower requirements.

U.S. Pat. No. 1,491,229 describes a shore for construction work which has a temporary support/locking device. The locking device is spring activated with a pocket which tapers upward and bearings urged by a spring. The bearings are retained in the pockets by means of the plungers and springs. Tools are required to adjust the locking device, which is inconvenient and time consuming.

U.S. Pat. No. 3,991,964 is directed to a telescoping prop for building construction. A housing is mounted at the top of the lower tube for locking the upper and lower tubes relative to each other. Bearings are disposed in a tapered area of the housing, wherein the taper has a step structure for holding the bearings in place. A locking device is required in conjunction with the bearings, which is inconvenient and complicated.

U.S. Pat. No. 6,299,113 is directed to a telescopic prop for furniture use, such as for adjusting the heights of chairs, tables, etc. Frictional resistance is provided to hinder the relative movements of the inner and outer cylinders. The mechanism merely produces a braking force, and is not a load mechanism capable of supporting high loads.

SUMMARY OF THE INVENTION

The following exemplary, non-limiting embodiments of the present invention are provided to overcome the above disadvantages, as well as other disadvantages not described herein.

An apparatus consistent with the present invention includes an outer tube, a plunger at least partially slidably disposed within said outer tube, and gravity-set wedging members disposed between an outer surface of the plunger and an inner surface of the outer tube for setting the plunger and the outer tube in place. The wedging members gouge the outer surface of the plunger and the inner surface of the outer tube upon inward axial movement of the plunger relative to the outer tube, so that the load support is yieldable in length when subjected to a compressive axial load. The wedging members are substantially self-setting under gravity.

According to another aspect of the invention, an apparatus consistent with the present invention includes an outer tube, a plunger at least partially slidably disposed within the outer tube, wedging members disposed between an outer surface of the plunger and an inner surface of the outer tube for locking the plunger and the outer tube in place. The wedging members gouge the outer surface of the plunger and the inner surface of the outer tube upon inward axial movement of the plunger relative to the outer tube. A collar is attached to an outer surface of the outer tube to increase strength of the outer tube, wherein the collar is disposed along a length of the outer surface of the outer tube which at least partially overlaps with the position of the wedging members.

A method consistent with the present invention includes a load support having an outer tube, a plunger at least partially slidably disposed within the outer tube, wedging members disposed between an outer surface of the plunger and an inner surface of the outer tube for setting the plunger and the outer tube in place, comprising: placing the load support in a position between two surfaces; sliding the plunger in an outward axial direction with respect to the outer tube until the plunger and the outer tube each contact one of the two surfaces, respectively; preloading the load support so that the wedging members set the inner and outer tubes in place with respect to each other; subjecting the load support to an axial compressive force, so that the wedging members gouge the inner surface of the outer tube and the outer surface of the plunger, thus causing the plunger to slide in an inward axial direction with respect to the outer tube.

BRIEF DESCRIPTION OF THE DRAWINGS

Non-limiting examples of the present invention are now described with reference to the accompanying drawings in which.

DETAILED DESCRIPTION OF THE INVENTION

Non-limiting, exemplary embodiments of the free standing support of the present invention will now be described in conjunction with the attached drawings.

In general, two different types of free standing supports are provided with the present invention: non-yielding props that gain strength more rapidly with closure and have a higher ultimate load usually, and yielding props. In the context of this application, yield refers to closure of the support, and in use this occurs when the distance between the roof and the floor reduces, mainly due to mining or other activity in the area.

Both the yielding and non-yielding supports use the same fundamental mechanism of gravity-set wedging members located in a sloping ramp arrangement for setting the inner and outer tubes in place with respect to each other. The wedging members may take the form of ball bearings, as described in greater detail below, as well as other forms such as needle bearings, conical needle bearings, tapered lock pins, split rings or split wedges. In the case of split rings and wedges, the split is thought to facilitate the relative movement between the tubes and is set mainly by gravity. However, any geometrically controlled shape that is hard enough to maintain its geometry while gouging and/or distorting the inner and outer tubes may be used. The wedging members tend to gouge inner and outer tubes of the supports, and in the case of the yielding support, the outer tube tends to expand. On the other hand, in the non-yieldable support, the outer tube is reinforced, for example, with a collar, so that the bearings are not as able to deform the outer tube, thus locking up and exceeding the buckling strength of the prop.

Both types of free standing supports have several features in common. For instance, the wedging members are self-setting, or at least substantially self-setting, under gravity and during installation. Due to the self-setting feature, tools are not required for installing the supports. Also, the wedging members interlock between the inner (plunger) and outer tubes, thus, generating a reactive load. Also, if the units have not been subjected to a load, the units can be removed and re-installed by inverting them and the prop can be closed down to its minimum height. This is easily accomplished since the device is freed by gravity due to the shape of the wedge and taper so that the inner and outer tubes unlock and can slide freely.

Figure 1:
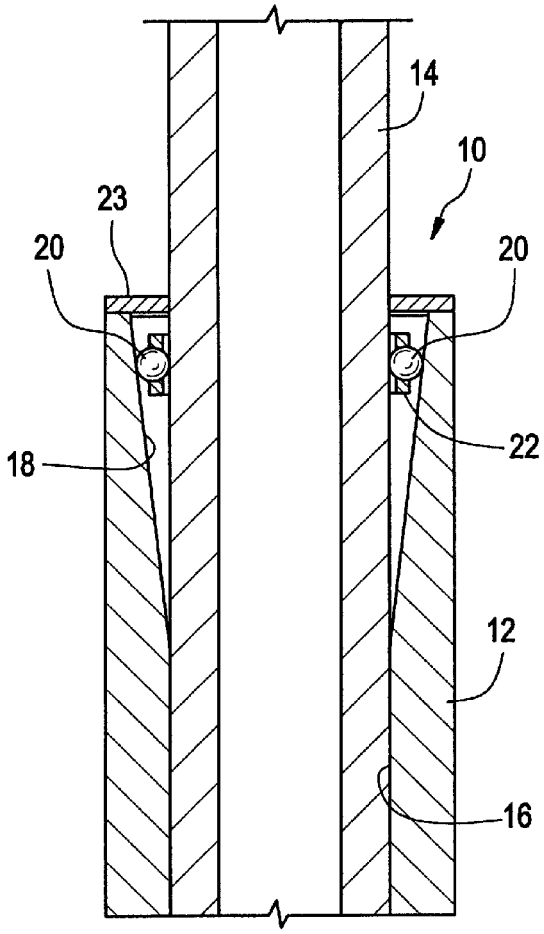
FIG. 1 is a sectioned side elevation of a central portion of a first embodiment of the invention.

FIG. 1 illustrates an exemplary first embodiment of a free support 10 of the present invention. The free support 10 includes an outer metal tube 12 and a plunger 14 which is freely slidable in a bore 16 of the outer tube 12. The plunger 14 may be formed as a tube, but is not limited as such for purposes of this invention.

The inner surface of the outer tube 12 is inwardly tapered from the upper end of the tube to provide a sloping ramp surface 18 which, at its lower end, shallows out onto the normal bore 16 of the outer tube 12. Thus, an area defined by the sloping ramp surface 18 and the outer surface of the plunger 14 is a frusto conically tapered cavity.

Figure 2:
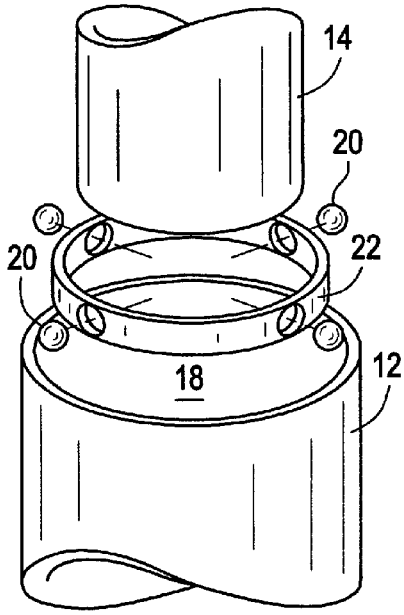
FIG. 2 is an exploded isometric view of the portion of the support illustrated in FIG. 1.

Wedging members 20 are located in the frusto conically tapered cavity between the outer tube 12 and the plunger 14 and are held in place in the tapered cavity opposite each other in a holed cage arrangement 22, as is more clearly shown in FIG. 2. The wedging members 20 may be ball bearings, rollers, tapered lock pins, needle bearings, wedge shaped members or the like. For purposes of illustration, the wedging members 20 shown in FIGS. 1 and 2, and throughout the description, are appropriately sized hardened ball bearings.

In the case of ball bearings, the diameter of each of the wedging members 20 is less than the space surrounding the plunger 14 at the upper end of the frusto conical gap so that upward movement of the plunger relative to the tube 12 will not be impeded in any way by engagement with the wedging balls 20 with the surfaces of the tube 12 and plunger 14.

Although only one ring 22 of wedging members 20 is shown in FIG. 1, the support 10 could include further rings 22 below that shown in FIG. 1, with the lower wedging members being appropriately sized for accommodation and function in the progressively diminishing tapered cavity which they are to occupy.

The upper end of the tube 12 cavity is closed, in this example, by an annular keep plate 23 which is made from thin-gauge metal which is welded or fixed mechanically to the upper end of the tube 12 to keep it in place. Alternatively, the keep plate could be a plastic member which is fixed to the outer tube 12 and which includes a downwardly dependent skirt which is holed to serve as a cage for the wedging members 20.

In actual use, the outer tube 12 is more elongated than shown in the drawings and the plunger 14 extends further upwardly. The lower end of the plunger 14 terminates well above the foot plate of the tube 12.

For transportation, the support is inverted from the position shown in FIG. 1 to free the wedging members 20 from the ramp surface 18 of the tube 12 and the outer surface of the plunger 14 as described above, and the plunger 14 is pressed fully into the outer tube 12 to reduce the length of the support 10 during transportation.

Since the unit is retractable in the above manner, it is also possible to re-install the unit if it is not under load. The unit is merely inverted and the inner plunger will retract back. However, it may be necessary to rotate it at the same time to help free the wedging member from the bottom of the tapered cavity or similarly shaped sloping ramp surface.

Figure 7:
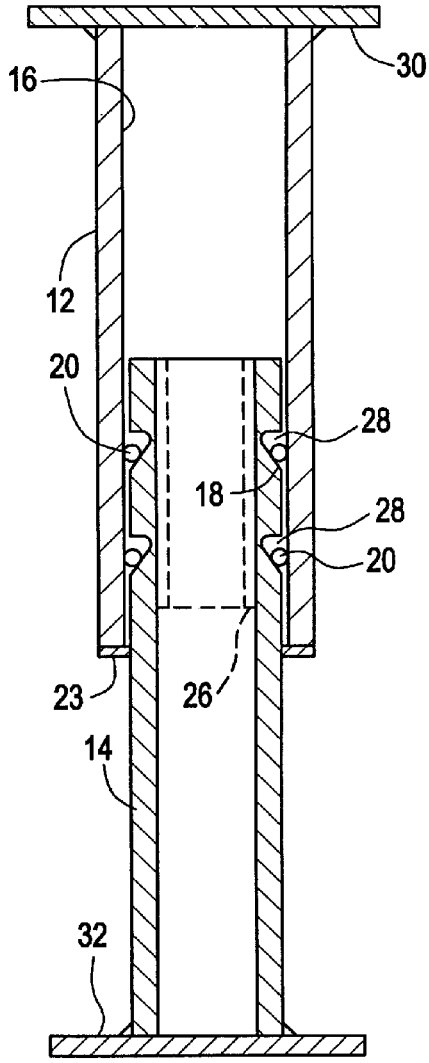
FIG. 7 shows a side elevation of a fourth embodiment of the invention.

Both of the tube 12 and the plunger 14 carry head/foot boards which are fixed to the upper and lower ends of the support. This feature is shown in more detail with respect to the fourth embodiment which is illustrated in FIG. 7 which shows an example of a head board 30 and a foot board 32. Although only shown in FIG. 7, head/foot boards may be used in any of the embodiments of the present invention.

In actual use for a mine, the support 10 is located in the orientation shown in FIG. 1, between the hanging and foot walls. The plunger 14 is then lifted from the tube 12 freely across the wedging members 20 which are rolled upwardly to a non-engaging position in the outwardly tapered cavity of the tube 12 to permit free upward sliding movement of the plunger 14 in the bore 16 of the tube 12 until its headboard is located against the mine working hanging wall. Setting tools are not required. The plunger 14 can be moved slightly up and down against the hanging to allow the wedging members 20 to wedge-set the plunger to the tube 12 under the force of gravity. Alternatively, the lower end of the tube 12 or the plunger 14 could carry in place of a foot or head board a liquid expansible preload device with which the plunger 14 located at or adjacent the hanging wall is filled with liquid at high pressure to extend the entire support in its axial direction in a preloaded condition between the hanging and foot walls.

In yet a further variation of the support, the bottom end of the plunger 14 could be closed and provided with one or more high pressure seals between it and the inner wall of the tube 12 and a one-way water inlet/pressure relief valve could be located through the wall of the tube 12 at the base of the support 10 for preloading the support by piston movement of the plunger 14 with water under pressure.

As the axial support load on the prop increases due to perhaps a closure of the hanging and foot walls between which it is located, the downward movement of the plunger 14 in the tube 12 will tend to roll the wedging balls downwardly in the prop cavity against an increasing radial load imposed by each of the wedging members 20 on the ramped surface 18 of the tube 12 and the outer wall of the plunger 14 until the wedging members 20 are jammed by wedging action in the tapered cavity.

The load support described thus far can be made to be one of the two types of props described earlier: yielding and non-yielding. With the first type of prop, the steel from which the tube and plunger are made could have a hardness which would enable them, or at least one of them, to be deformed by the wedging members 20. In this case, further downward movement of the plunger 14 into the tube 12 beyond the position at which the members 20 initially lock the tube and plunger together, could cause the members 20 to dig into the tube and/or plunger surfaces against which they bear, to score both or the softer of the two surfaces, and in so doing to gouge grooves in the outer wall of the plunger 14 and/or the tube 12 while enabling the support to remain load supporting while yielding in length. Moreover, the inner and/or outer tubes may be deformed, providing a further yielding characteristic to the support. Thus, this combination of gouging and tube deformation creates a stable yield for the support.

In the second type of prop, the steel of the outer tube and plunger could be selected to be significantly harder than those of the first type of prop to make the prop non-yieldable for use in areas where there is little or no closure expected between the surfaces against which the ends of the prop bear. However, the same metallurgy may be used for both types of props. Depending mainly on the steel properties of each tube, the wall thickness, the diameter and the number of bearings, the load generation is a combination of gouging the plunger, the outer tube or both the plunger and outer tube, and possibly deforming one or both of the outer tube and plunger. Moreover, the present invention is not limited to steel, as other types of metals may be used, especially in applications outside the mining field.

Figure 3:
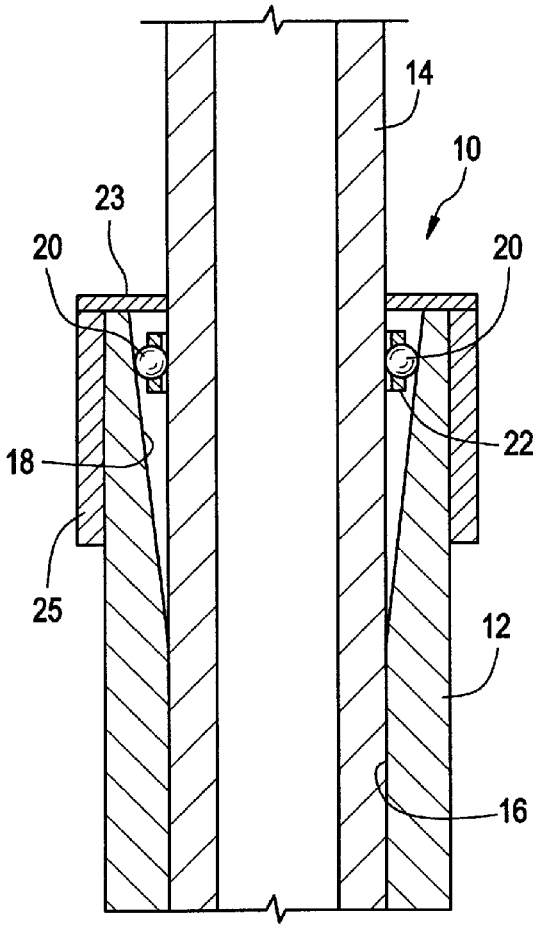
FIG. 3 illustrates a sectioned side elevation of a central portion of the support illustrated in FIG. 1 utilizing a non-yielding collar.

Still further, in the non-yielding type of prop, a collar 25 may be provided as illustrated in FIG. 3. This variation of the first embodiment is similar to that shown in FIG. 1, except for the addition of the collar 25. As shown in FIG. 3, to inhibit radially outward deformation of the thinned upper ends of the walls of a yieldable support, the collar 25 can be attached to the upper end of the tube 12, to increase the hoop strength of the tube along its length which is protected by the collar 25. With the deformation tendency removed, or at least greatly decreased, the unit is stiffened. By using a reinforcing ring, or collar, of limited length, e.g. 2 inches or less, the early stiffness (strength gain) of a yielding unit could be increased. Thus, with the addition of the collar 25, a yieldable prop could be made to be non-yieldable. It is noted that the collar length is not limited to 2 inches, and may be longer, such as 3 inches or more. Moreover, the collar can be attached by any means necessary such as welding, pressing, or other means for providing an integral structure.

Figure 4:
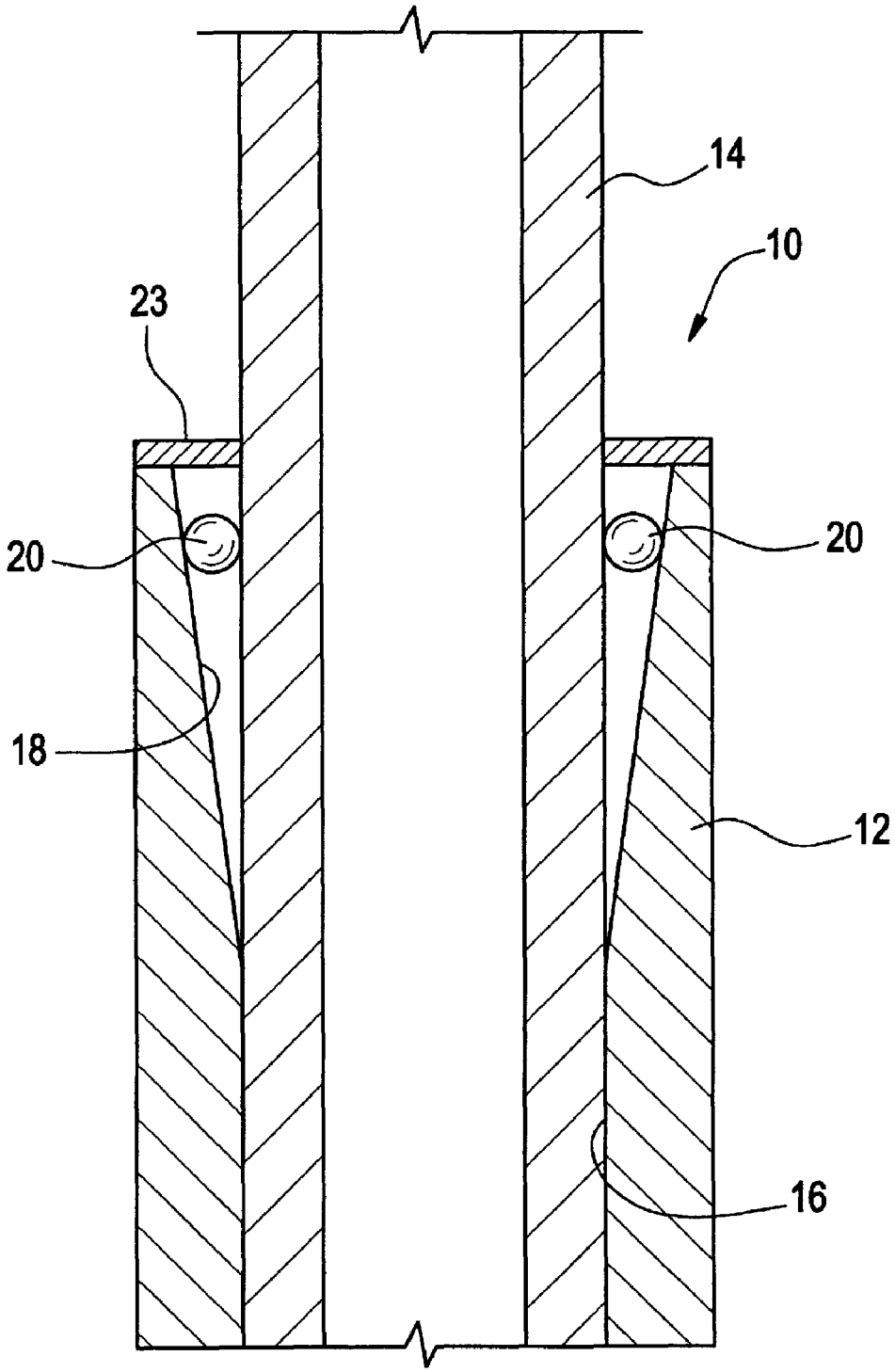
FIG. 4 is a sectioned side elevation of a central portion of a second embodiment of the invention.

A second embodiment of the invention is illustrated in FIG. 4, in which the cage 22 is omitted. In the second embodiment of the invention, if only a single layer of wedging members 20 are used, the taper can be made just deep enough that the wedging members 20 cannot roll over each other even though the cage 22 is omitted. Except for the omission of the cage 22, the configurations and functions are the same as those of the first embodiment, and therefore, by using the same reference numerals, the detailed description thereof is omitted.

Thus, with the second embodiment, if only one layer of wedging members is being used, the cage may be omitted, and the wedging members simply roll and wedge into the tapered cavity as the plunger and outer tube are moved relative to each other.

Elimination of the cage in the second embodiment tends to make re-installing the prop easier. In particular, the cage may get stuck between the tubes in the first embodiment.

All other features and variations of the first embodiment may be applied to the second embodiment of the invention. Thus, the various forms of the wedging members, the structure of the plunger and outer tube, the use of head/foot boards, utilization of high pressure seals and one-way relief valve, and adaptability to be yielding or non-yielding with a collar, also apply to the second embodiment of the invention. Since these configurations and functions are the same as those of the first embodiment, a detailed description thereof is omitted.

In a third embodiment of the invention, the tapered cavity structure of the second embodiment may be replaced with a fluted or slot arrangement, which may hold one or more layers of wedging members as will now be described.

Figure 5A:
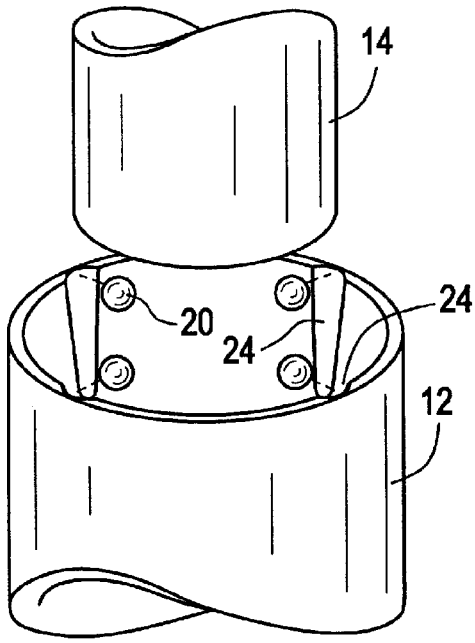
FIGS. 5A and 5B illustrate an exploded isometric view of a third embodiment of the invention.

In FIG. 5A, the inner surface of the tube 12 is not fully tapered as in FIGS. 1 and 4, but includes, in this third embodiment, four tapered flutes 24 which are machined into the inner side wall of the outer tube 12 and in which the wedging members 20 are located.

Figure 5B:
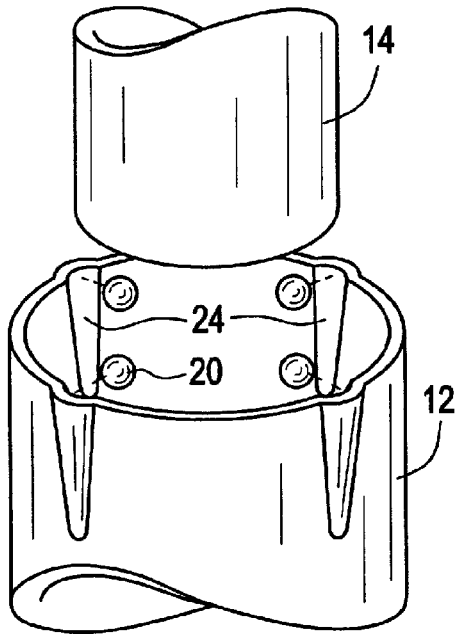

In the alternative third embodiment of FIG. 5B, the flutes 24 are pressed into the side wall of the outer tube 12 instead of being machined.

The third embodiment of the present invention is not limited to the use of four flutes or slots, but any number of flutes/slots may be used depending on the effects desired.

Figure 6A:
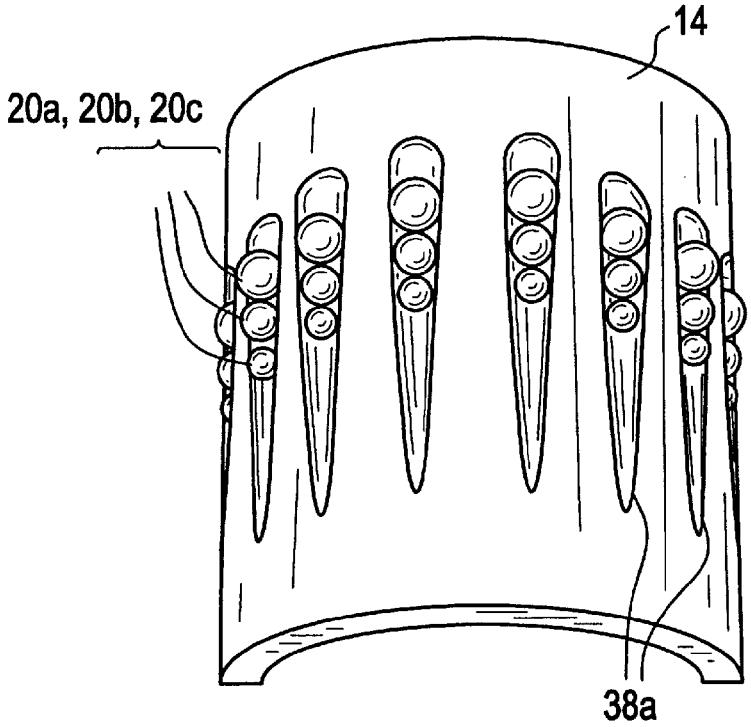
FIGS. 6A and 6B illustrate a detailed view of the third embodiment utilizing various sized ball bearings.
Figure 6B:
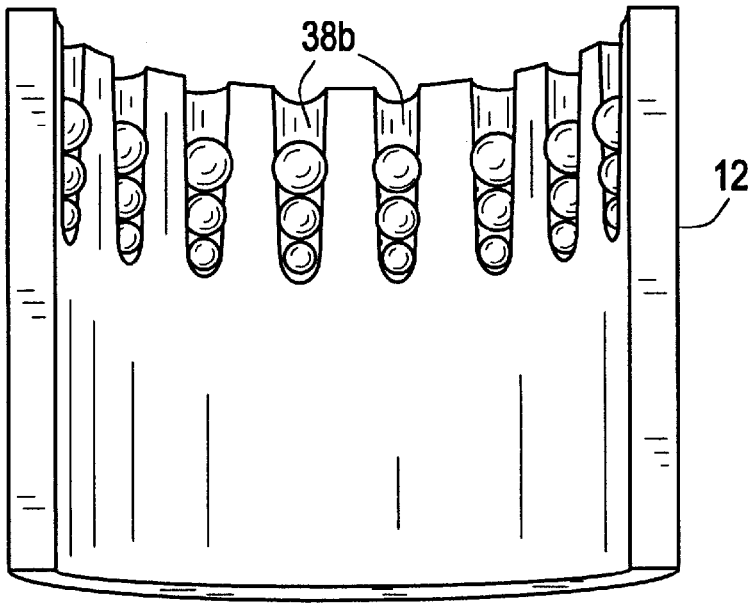

Still further, as with the first embodiment, more than one wedging member may be used in each flute/slot as described with respect to FIGS. 6A and 6B. However, unlike the first and second embodiments, even though more than one layer of wedging members is used, a holed cage 22 is not present.

FIGS. 6A and 6B illustrate a support having more than four flutes/slots. In this arrangement, different sized wedging members 20, e.g. hardened steel ball bearings, are provided in each tapered flute/slot. In this example, three different sized bearings 20*a*, 20*b*, 20*c* are provided from smallest to largest, with the smallest being disposed closer to the lowest position of the taper, i.e., the narrower portion of the tapered flute. The ball bearings act in synergy because the smallest makes a path for the larger making them effectively cut-in to the walls of the tube faster, thus, increasing the initial load. In this example, a plurality of tapered slots 38*a*, 38*b*, which face each other, are provided circumferentially around the plunger 14 and outer tube 12, to create a space between the inner surface of the outer tube 12 and the outer surface of the plunger 14 to accommodate the bearings 20*a*, 20*b*, 20*c*.

FIGS. 6A and 6B illustrate the effect of the ball bearings 20*a*, 20*b*, 20*c* on the tapered slots 38*a*, 38*b* after they have been exposed to load conditions. Here, the three ball bearings in each slot are nested together, having gouged the tapered slots upon compressive load conditions.

With this aspect of the present invention, the multiple balls in the slots have various sizes so that they contact the tapered surface at the same time. The three ball bearings in each slot act in synergy because the smallest makes a path for the larger ones, making them effectively "cut-in" faster, increasing the initial load. With this structure, there is an increase in the number of contact pressure points between the inner and outer tubes and the smaller bearings make gouged tracks for the larger ones, making them seat far quicker and with greater surface area than with a single sized ball. Thus, the rate of load gain is increased.

For example, if three different sized bearings are used, sized as 0.25 in., 0.187 in., and 0.156 in, with the smallest being the lowest on the tapered surface, the tubes travel only about 1.25 inches to reach the locking point. In contrast, if three bearings are used, each sized at 0.25 in., the tubes travel 3 inches before locking. Thus, the use of different sized bearings speeds up the locking process by reducing the amount of travel in the prop before locking.

Due to the nature of the sped up locking process that occurs with the wedging members described in FIGS. 6A and 6B, this structural arrangement which employs different sized bearings is best suited for a non-yielding prop. However, the use of different sized bearings has potential use in a yielding prop, especially if a soft material and/or smaller sized bearings are used.

The third embodiment described with respect to FIGS. 5A, 5B, 6A and 6B functions in a similar manner to that described with respect to the first and second embodiments. Namely, the relative movement of the plunger 14 and the outer tube 12 in conjunction with the force of gravity, cause the wedging members 20 to move further downward into the tapered flutes/slots, thus, setting the plunger 14 and outer tube 12 with respect to one another. Still further, this embodiment may be utilized with a yielding or non-yielding prop, and thus, the choice of steel hardness, thickness, and whether a collar is used, depend upon whether a yielding or non-yielding prop is desired. Still further, the choice of wedging member is not limited, and the outer tube and plunger structure, use of head/foot boards, high pressure seals and one-way relief valves of the previous embodiments are applicable to this third embodiment.

A fourth embodiment of the invention is shown in FIG. 7. The fourth embodiment does not use a caged arrangement or tapered flutes/slots as in the previous embodiments, but rather one or more rows of circumferential grooves 28 for holding a plurality of wedging members 20.

Here, the sloping ramp surfaces are located in the plunger 14, and are in the form of two continuously circumferential grooves 28 which are shaped as shown with the ramp surfaces extending from their upper ends downwardly and outwardly to the outer surface of the plunger 14. The grooves 28 extend completely around the circumference of the plunger 14. It may be necessary to weld a short length of hoop reinforcing tube 26, shown by dotted line, to prevent the plunger 14 from being inwardly deformed in the area of the ramp surface forming grooves 28. Also, a collar 25 as shown in FIG. 3 can be fixed to the lower end of the outer surface of the tube 12. Thus, the embodiment illustrated in FIG. 7 may be yieldable or non-yieldable in length under load.

The keep plate 23 may be provided to serve a stop to prevent the upward movement of the tube 12 beyond the lower wedging members 20 to prevent the tube 12 and plunger 14 from being separated from each other, and also to prevent the support 10 from being set without a minimum stabilizing length of the plunger 14 in the tube 12.

The fourth embodiment described with respect to FIG. 7 functions in a similar manner to that described with respect to the other embodiments. Namely, the relative movement of the plunger 14 and the outer tube 12 in conjunction with the force of gravity, cause the wedging members 20 to move further downward into the circumferential grooves 28, thus, setting the plunger 14 and outer tube 12 with respect to one another. Still further, this embodiment may be utilized with a yielding or non-yielding prop, and thus, the choice of steel hardness, thickness, and whether a collar is used, depend upon whether a yielding or non-yielding prop is desired. Still further, the choice of wedging member is not limited, and the outer tube and plunger structure, use of head/foot boards, high pressure seals and one-way relief valves are applicable to this fourth embodiment.

In addition, the circumferential groove may be formed by cutting a chamfer around the perimeter of the inner surface of the outer tube or the outer surface of the plunger (inner tube).

As described with respect to the first through fourth embodiments, and their various deviations, a free standing support prop is provided which may be provided with a yielding or non-yielding characteristic, by utilizing a collar for instance. Gravity-set wedging members, in the form of ball bearings for instance, are used in conjunction with a sloping ramp surface to achieve a substantially self-setting arrangement for the support prop. Such a sloping ramp surface may take the form of a tapered cavity, slots and flutes, or circumferential grooves, for instance. The sloping ramp surface may be formed on the outer tube or the inner plunger, or a combination of both. Still further, the wedging members may vary in structure and number.

The present invention provides a significantly easier assembly and set-up than conventional prop devices because the present invention utilizes a self-setting lock design. Due to the self-setting property of the gravity-set wedging members, the props can be installed without the use of tools. Moreover, the wedging members gouge the surfaces of the inner and outer tubes which facilitates the locking and stability of the prop. For instance, in a yielding prop, a 50 T capacity on the prop will result in about an $^{80}/_{1000}$ inch gouge on each tube. This gouging characteristic is significant in obtaining the desired yielding stability. Moreover, the non-yielding prop will undergo an even deeper gouging, thus causing the gravity-set wedging members to lock into place.

These various embodiments of the present invention have undergone extensive testing by the inventors. The following discussion describes the results of such testing.

It has been determined that a taper or slot angle of 12° or less is preferable. A larger angle can cause the wedging members to bounce out, particularly under rapid load conditions. Alternatively, if wedging members other than ball bearings are used, the grip between the tubes can be adequate initially or cause slippages.

The cutting of slots or tapers to the plunger, e.g., inner tube, in either a yielding or non-yielding unit has several advantages. First, the prop cannot be overextended because the key plate around the outer tube would prevent this problem. This is an important safety feature, because prior art props can be overextended since only tape or a paint mark are made on the telescoping tube section to indicate the limit of extending the tubes. Since this can be easily ignored or removed in the field, a hazardous situation can ensue, or at the very least, units are wasted since an extra unit must be installed when this occurs.

In addition, having the slots or tapers on the inner tube allows for more than one row of slots or a single groove cut. This can help align the outer tube and inner tube with each other to limit eccentric loading, for example. Still further, additional rows of slots or multiple grooves can be provided to stiffen a non-yielding unit.

In the case where ball bearings are used as the wedging members, a diameter between 0.125" to 0.250" was found to be the most effective. By varying the number of ball bearings used, the yielding of the support can be manipulated.

The wedging members do not necessarily have to be evenly distributed around the unit. If the members are located mainly on one side, the tubes can be forced to slide against each other creating additional frictional forces. This design could make a non-yielding prop even more stiff which could be desirable in certain situations.

With respect to the outer tube, the outer diameter and wall thickness may be varied depending on required load capacity, height, etc. A diameter of 2.875-3.5 inches with a 0.250 inch wall thickness performed well with props that were up to 9 feet high.

Also, the inner and outer tube properties, such as the yield stress, affect the performance of the prop.

Figure 8:
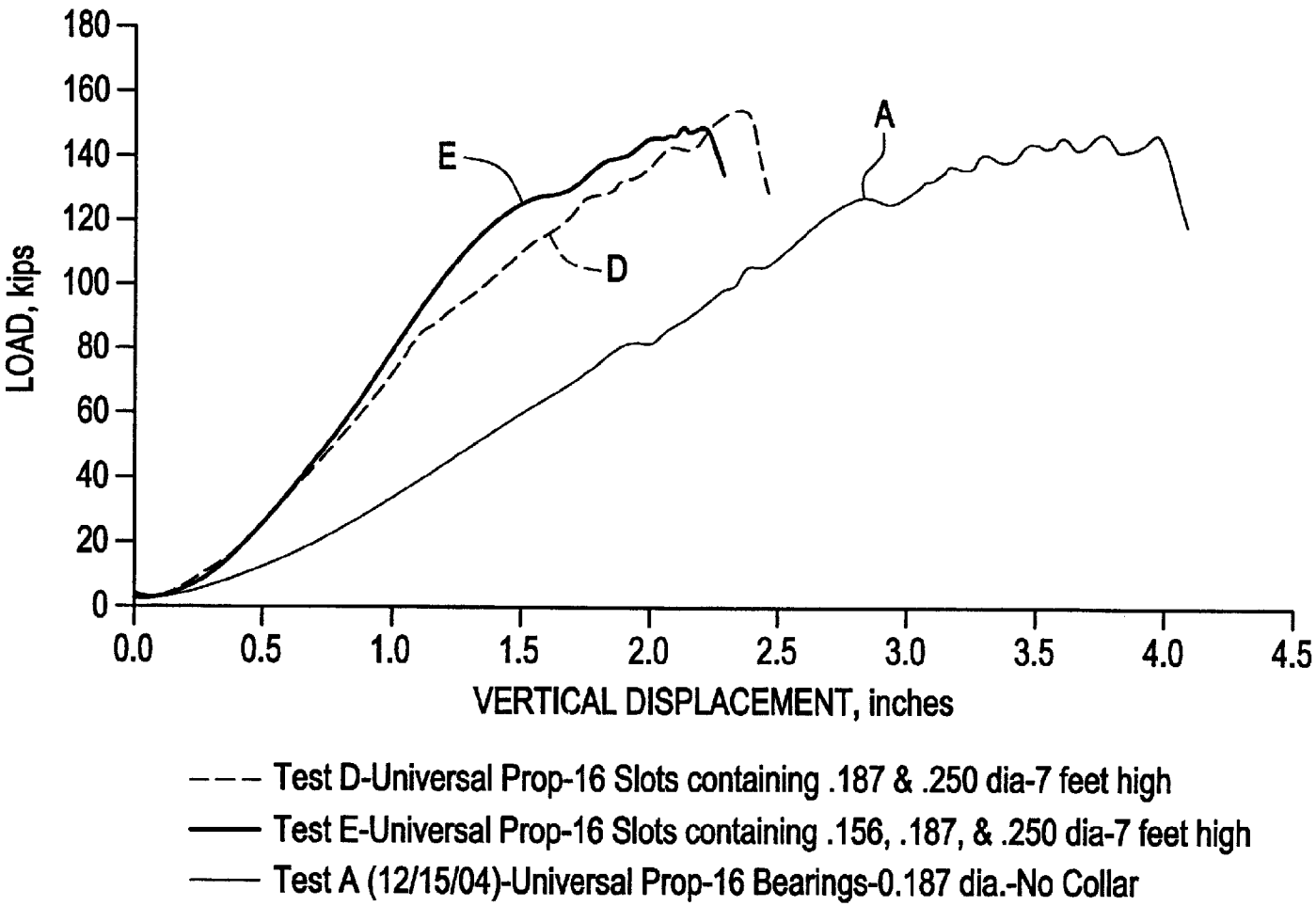
FIG. 8 shows a graph comparing three prop designs.

FIG. 8 illustrates a graph comparing the testing of three prop designs. All three props used 16 slots as the ramping slope surface feature. Test A refers to a prop which used a single ball bearing in each of the 16 slots, each bearing having the same diameter, and the rate of strength gain was too slow for most underground applications. Test D refers to a prop which used a 3" reinforcing collar and two ball bearings in each slot. Test E refers to a prop which also used a 3" reinforcing collar, but held three ball bearings in each slot.

Figure 9:
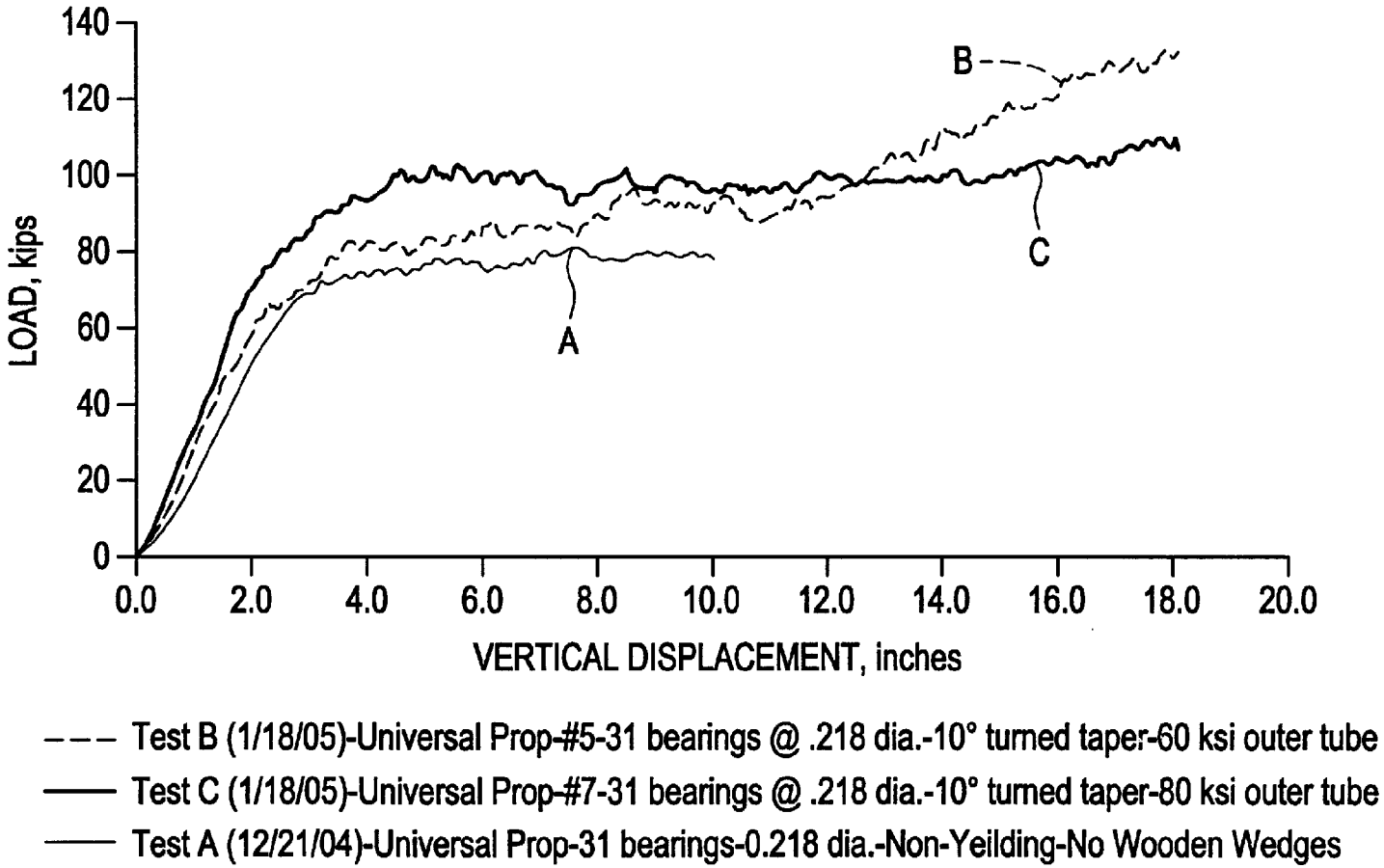
FIG. 9 shows a graph comparing three additional prop designs.

FIG. 9 illustrates a graph comparing the testing of three additional prop designs, to show the difference in load bearing when the outer tube strength is increased and all other factors remain constant. Here, all three props used 31 ball bearings evenly spaced in a 10° tapered cavity as the ramping slope surface feature. Test A refers to a prop having an outer tube with a yield stress of 50 ksi. Test B refers to a prop having an outer tube with a yield stress of 60 ksi, and test C refers to a prop having an outer tube with a yield stress of 80 ksi.

Figure 10:
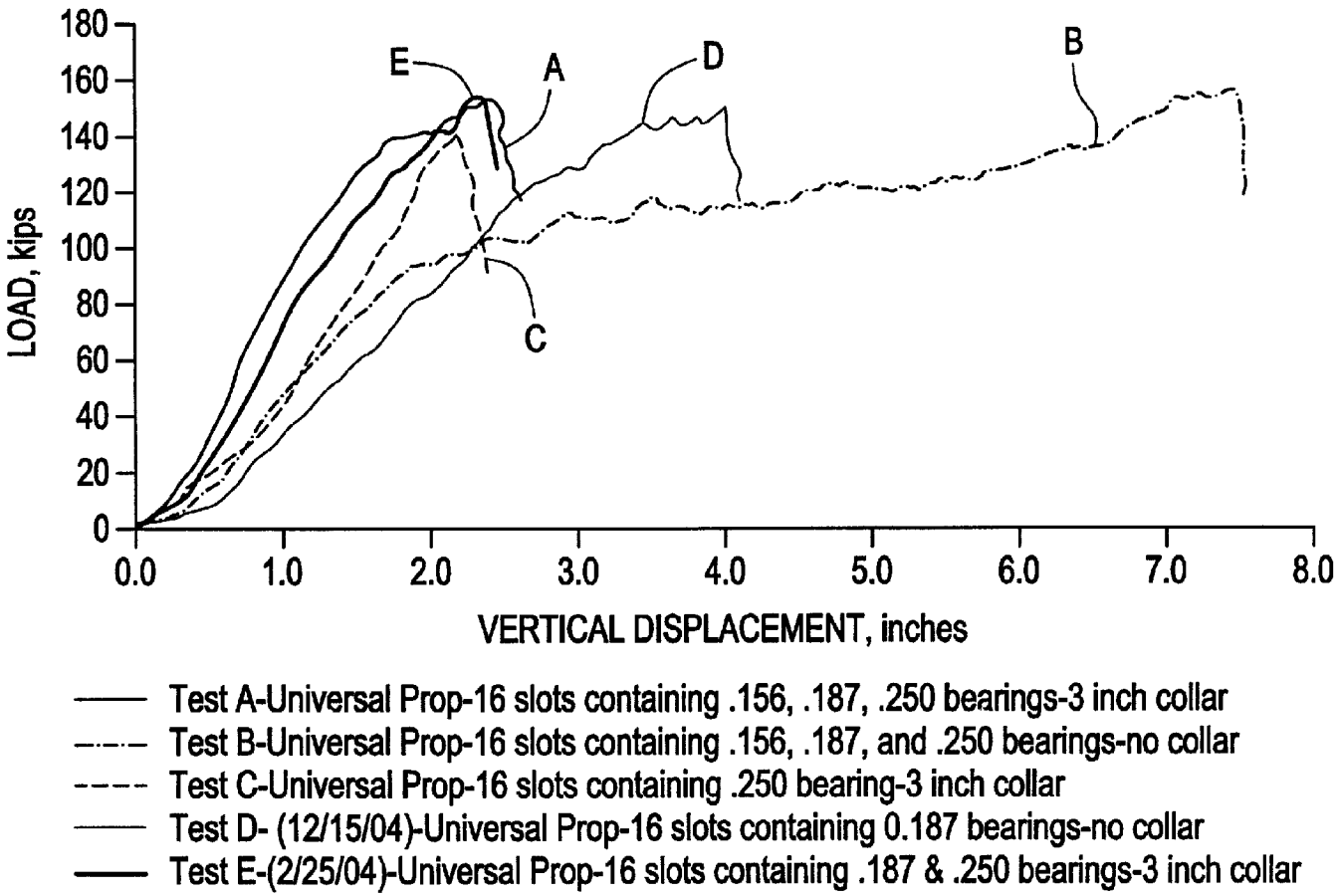
FIG. 10 shows a graph comparing five prop designs.

FIG. 10 illustrates the effects of stiffening the prop, which improves its early strength. Test A shows a preferred, non-yield version with 16 slots, three bearings in each slot and a reinforcing collar around the outer tube to limit the bearings from expanding the outer tube and, hence, yielding. Test B is similar to Test A, but it has no reinforcing collar. The difference between B and A emphasize the significant stiffening effect of the collar. Test C is similar to Test B, however there is only one bearing per slot. Here, the difference between C and A emphasizes the stiffening effect of adding the two additional bearings per slot. Test D is similar to Test A, except there is no collar and only one bearing per slot. Finally, Test E is similar to Test A except there are only two bearings per slot.

Further testing by the inventors has shown that supports having slots with fewer bearings tend to be stiffer than supports with a full turned taper having more bearings.

The present invention has many applications. With respect to coal mining applications, the invention can be used with longwall recoveries, tailgate supports, maingate supports, belt entries, bleeder entries, to replace cribs and to support beams. With respect to hard rock mining applications, the present invention is very effective and improves safety on deep tabular mines. It may be used as a face and internal panel stop support that is installed near the face and left in, during rescue operations to secure unsafe ground very quickly and easily. Further it can be used as a bullnose support (at a tunnel breakaway), and as a support in tunnels where means are needed across the excavation.

The present invention also has many non-mining applications. It may be useful in constructions sites (e.g. when pouring floors), for emergency response services (to shore up damages structures during and after fires or other disasters), for supports in basements, and as an adjustable support for any application needing to support a load.

With the present invention, many advantages and benefits are realized. For instance, tools are not required to set up the props because they are substantially gravity-set, the props can be re-installed if not under load, a single person can install the prop, the prop is relatively light weight compared to conventional props, and the installation is fast and easy.

Moreover, a two foot height minimum height extension is featured. For example, a 7-9 ft. unit may have a 7 ft. outer tube and a three foot inner tube (plunger), allowing for a 1 ft. overlap and a 2 ft. height extension. Also, for example, a 6-9 ft. unit may have a 6 ft. outer tube and a 4 ft. foot inner tube, allowing for a 1 ft. overlap and a 3 ft. height extension.

Still further, the prop can be preloaded, by using a Jackpot (a pressurized bladder that expands when filled with high pressure water), a simple timber wedge or small threaded section fitted to the top or bottom of the prop, etc. Another benefit of the present invention is that the props can be fitted with different sized and shaped head and foot plates.

With the yielding prop versions, a high load capacity of 50 tons is available, and it has a stable yield of up to two feet. The non-yielding prop version, feature a high load capacity of 75 tons and a high strength gain. Other load capacities can be made mainly by changing the tube diameters and wall thicknesses.

The invention is not limited to the precise details as herein described. For example, the tube 12 could be made short, as shown in FIG. 1, and located on any support capable of handling designed loads such as conventional wooden props which would need a hole bored axially into them to accommodate the plunger as the prop yields under the load. The smaller load support unit could also be attached to an appropriate steel tube at its place of use where, for example, importation of the entire support would be cost prohibitive.

Still further, for example, the outer tube could be replaced by a timber pole, especially at higher heights of more than 10 feet, where it would be cheaper than using a steel outer tube. However, this variation would be heavier and more onerous to transport and install.

Further, it should be understood that the present invention is not limited to any exemplary embodiment described above and those skilled in the art may make various modifications and changes without departing from the spirit and scope of the invention, the scope of which is defined by the claims attached hereto and their equivalents.

What is claimed is:

1. A yieldable load support, comprising:

an outer tube;

a plunger at least partially slidably disposed within said outer tube; and a tapered cavity formed between an outer surface of said plunger and an inner surface of said outer tube, wherein the tapered cavity is inwardly tapered away from an upper end of the outer tube; and at least one gravity-set wedging member disposed in said tapered cavity so that said wedging member is movable in said tapered cavity in an axial direction of the load support, wherein an initial downward movement of said plunger in said outer tube causes said wedging members to move in a same downward direction within said tapered cavity so as to be in a wedged position in the tapered cavity thereby causing said outer tube and said plunger to initially stably set together in a set position, and an additional downward movement of said plunger in said outer tube beyond the set position is allowed by the wedging member gouging into said outer tube and said plunger in a position below the wedged position, so as to enable the load support to remain stably load supporting while shortening the overall length when subjected to a compressive axial load after said outer tube and said plunger are set together in the set position.

2. The yieldable load support according to claim 1, wherein the tapered cavity is defined by a sloping ramp surface formed on the inner surface of said outer tube for receiving said wedging members that are movable on the ramp surface in an axial direction of the load support.

3. The yieldable load support according to claim 1, wherein a sloping ramp surface is formed on the outer surface of said plunger for receiving said wedging members that are movable on the ramp surface in an axial direction of the load support.

4. The yieldable load support according to claim 1, wherein a sloping ramp surface is formed on each of the outer surface of said plunger and the inner surface of said outer tube so as to face each other, for receiving said wedging members that are movable on the ramp surfaces in an axial direction of the load support.

5. The yieldable load support according to claim 1, wherein said wedging members are ball bearings that are formed of incrementally larger diameters, and are disposed along an axial direction of the load support, from smallest to largest diameter, with the smallest diameter ball bearing being disposed in the lowest position.

6. The yieldable load support according to claim 2, wherein said sloping ramp surface is a tapered surface formed on the inner surface of said outer tube, wherein said tapered surface and said outer surface of said plunger form a tapered cavity, wherein said tapered cavity holds said wedging members therein.

7. The yieldable load support according to claim 2, wherein said sloping ramp surface is a tapered slot formed on the inner surface of said outer tube, wherein said wedging members are disposed within said tapered slot so as to be pressed against said plunger.

8. The yieldable load support according to claim 3, wherein said sloping ramp surface is a circumferential groove formed on the outer surface of said plunger, wherein said wedging members are disposed within said circumferential groove so as to be pressed against said outer tube.

9. The yieldable load support according to claim 6, wherein said wedging members are ball bearings that are formed of incrementally larger diameters, and are disposed along an axial direction of the load support, from smallest to largest diameter, with the smallest diameter ball bearing being lowest.

10. The yieldable load support according to claim 7, wherein said wedging members are ball bearings that are formed of incrementally larger diameters, and are disposed along an axial direction of the load support, from smallest to largest diameter, with the smallest diameter ball bearing being disposed in the lowest position.

11. The yieldable load support according to claim 8, wherein said wedging members are ball bearings that are formed of incrementally larger diameters, and are disposed along an axial direction of the load support, from smallest to largest diameter, with the smallest diameter ball bearing being disposed in the lowest position.

12. The yieldable load support according to claim 6, further comprising a holed ring cage for accommodating the wedging members therein, said holed ring cage being disposed in said tapered cavity so as to surround a perimeter of said plunger, wherein said wedging members are accommodated in holes of said holed ring cage.

13. A load support, comprising:

an outer tube;

a plunger at least partially slidably disposed within said outer tube;

a tapered cavity formed between an outer surface of said plunger and an inner surface of said outer tube, wherein the tapered cavity is inwardly tapered away from an upper end of the outer tube;

at least one gravity-set wedging member disposed in said tapered cavity so that said wedging member is movable in said tapered cavity in an axial direction of the load support, wherein an initial downward movement of said plunger in said outer tube causes said wedging member to move in a same downward direction within said tapered cavity so as to be in a wedged position in the tapered cavity thereby causing said outer tube and said plunger to initially stably set together in a set position, and an additional downward movement of said plunger in said outer tube beyond the set position is allowed by the wedging member gouging into said outer tube and said plunger in a position below the wedged position, so as to enable the load support to remain stably load supporting while shortening the overall length when subjected to a compressive axial load after said outer tube and said plunger are set together in the set position; and a collar which is welded to an outer surface of said outer tube to increase strength of the outer tube, wherein said collar is disposed along a length of the outer surface of said outer tube which at least partially overlaps with the position of said wedging members.

14. The load support according to claim 13, wherein the tapered cavity is defined by a sloping ramp surface is formed on the inner surface of said outer tube for receiving said wedging members that are movable on the ramp surface in an axial direction of the load support.

15. The load support according to claim 13, wherein a sloping ramp surface is formed on the outer surface of said plunger for receiving said wedging members that are movable on the ramp surface in an axial direction of the load support.

16. The load support according to claim 13, wherein a sloping ramp surface is formed on each of the outer surface of said plunger and the inner surface of said outer tube so as to face each other, for receiving said wedging members that are movable on the ramp surfaces in an axial direction of the load support.

17. The load support according to claim 13, wherein said wedging members are ball bearings that are formed of incrementally larger diameters, and are disposed along an axial direction of the load support, from smallest to largest diameter, with the smallest diameter ball bearing being disposed in the lowest position.

18. The load support according to claim 14, wherein said sloping ramp surface is a tapered slot formed on the inner surface of said outer tube, wherein said wedging members are disposed within said tapered slot so as to be pressed against said plunger.

19. The load support according to claim 15, wherein said sloping ramp surface is a circumferential groove formed on the outer surface of said plunger, wherein said wedging members are disposed within said circumferential groove so as to be pressed against said outer tube.

20. The load support according to claim 14, wherein said wedging members are ball bearings that are formed of incrementally larger diameters, and are disposed along an axial direction of the load support, from smallest to largest diameter, with the smallest diameter ball bearing being disposed in the lowest position.

21. The load support according to claim 18, wherein said wedging members are ball bearings that are formed of incrementally larger diameters, and are disposed along an axial direction of the load support, from smallest to largest diameter, with the smallest diameter ball bearing being disposed in the lowest position.

22. The load support according to claim 19, wherein said wedging members are ball bearings that are formed of incrementally larger diameters, and are disposed along an axial direction of the load support, from smallest to largest diameter, with the smallest diameter ball bearing being disposed in the lowest position.

23. The load support according to claim 14, further comprising a holed ring cage for accommodating the wedging members therein, said holed ring cage being disposed in said tapered cavity so as to surround a perimeter of said plunger, wherein said wedging members are accommodated in holes of said holed ring cage.

* * * * *